US009392868B2

(12) United States Patent
Nardi

(10) Patent No.: US 9,392,868 B2
(45) Date of Patent: Jul. 19, 2016

(54) PORTABLE BEACH AND POOL TABLE

(71) Applicant: Sandra Nardi, Damascus, MD (US)

(72) Inventor: Sandra Nardi, Damascus, MD (US)

( * ) Notice: Subject to any disclaimer, the term of this patent is extended or adjusted under 35 U.S.C. 154(b) by 0 days.

(21) Appl. No.: 14/023,742

(22) Filed: Sep. 11, 2013

(65) Prior Publication Data

US 2015/0068433 A1 Mar. 12, 2015

(51) Int. Cl.

| | |
|---|---|
| ***A47B 37/00*** | (2006.01) |
| ***A47B 9/00*** | (2006.01) |
| ***A47B 13/16*** | (2006.01) |
| ***A47B 37/04*** | (2006.01) |

(52) U.S. Cl.

CPC . *A47B 9/00* (2013.01); *A47B 13/16* (2013.01); *A47B 37/04* (2013.01)

(58) Field of Classification Search

CPC ..... A47B 37/04; A47B 2220/0008; A45B 2025/003

USPC ..... 108/50.12, 25, 26, 35, 34; 135/16

See application file for complete search history.

(56) References Cited

U.S. PATENT DOCUMENTS

| | | | | | |
|---|---|---|---|---|---|
| 1,211,829 | A * | 1/1917 | Eades | ..... | 108/35 |
| 2,454,202 | A * | 11/1948 | Pierik | ..... | 108/173 |
| 4,584,946 | A | 4/1986 | Tucker et al. | | |
| 4,623,367 | A * | 11/1986 | Paulson | ..... | 108/50.12 |
| 4,826,244 | A | 5/1989 | Choi | | |
| 5,092,615 | A | 3/1992 | Gregalis | | |
| 5,417,166 | A * | 5/1995 | Credle, Sr. | ..... | 108/50.12 |
| 6,321,662 | B1 * | 11/2001 | Fraise | ..... | 108/25 |
| 6,705,240 | B2 * | 3/2004 | Block et al. | ..... | 108/150 |
| 6,889,618 | B1 * | 5/2005 | Gromack | ..... | 108/50.12 |
| D642,407 | S * | 8/2011 | Pirkl | ..... | D6/511 |
| 8,381,662 | B2 * | 2/2013 | Goldszer | ..... | 108/50.12 |
| 2002/0040667 | A1 * | 4/2002 | Birsel et al. | ..... | 108/25 |
| 2007/0056482 | A1 * | 3/2007 | Robinson et al. | ..... | 108/25 |

* cited by examiner

*Primary Examiner* — Jose V Chen

(74) *Attorney, Agent, or Firm* — Sean S. Wooden; Andrews Kurth LLP

(57) ABSTRACT

A portable folding outdoor table includes a foldable table top including a flat top and includes foldable portions joined together at joint(s) that extend through the table top and bottom, cup holders extending through the table top, a beach umbrella shaft substantially positioned in the center, extending through the table top and sized to accept a shaft of a beach umbrella, holes defined by the table top, where the holes are smaller in diameter than the cup holders and permit wind to blow through the table top, and foldable legs attached to the table top bottom, where the foldable legs are designed to position the table top at a height in the range of 10" to 20" above a ground surface on which the portable outdoor table sits.

16 Claims, 2 Drawing Sheets

PORTABLE BEACH AND POOL TABLE

FIELD

The invention relates generally to portable outdoor furniture, particularly portable folding outdoor tables.

BACKGROUND

Going to the beach or the pool is a popular pastime for many during the summer time months. When going to the beach or pool, people usually bring portable folding beach chairs to sit on. Typically such chairs sit low to the ground so that the user can relax with their feet stretched out on the warm sand and/or be covered from the sun by a beach umbrella they have stuck in the sand.

Many times, people sitting on the beach or at the pool want to have a nice cool drink with them. Some folding beach chairs have drink holders, but usually these are limited in size and do not securely hold the beverages. Moreover, often people want to have food while they are the beach and need a flat surface to place the food on. Consequently, there is a need for portable tables that can be used on the beach or pool.

Currently, there are portable tables that can be used on the beach or at the pool. However, most of these are not appropriately sized for the low-sitting portable folding beach chairs. Many portable tables are too high to be of much use for such chairs. Furthermore, many portable tables are too unstable to use on a surface such as the beach or in the windy conditions that often occur outdoors at the beach or pool. Additionally, drinks set on such tables often tip over or simply slide off. Finally, many portable tables are not adapted to work with beach umbrellas.

What is needed is a portable folding outdoor table that is suitable for use at the beach or pool and that overcomes the above disadvantages.

SUMMARY

Embodiments described herein overcome the disadvantages of the prior art. These and other advantages are achieved by, for example, a portable folding outdoor table, that includes a foldable table top including a substantially flat top surface, an opposite facing bottom surface, said table top including two or more foldable portions joined together at one or more joints that extend through said top surface and said bottom surface, one or more cup holders extending through said top surface and said bottom surface, a beach umbrella shaft hole defined by said table top, substantially positioned at said table top center, and extending through said top surface and said bottom surface, said beach umbrella shaft hole is sized to accept a shaft of a beach umbrella, a plurality of holes defined by said table top and extending through said top surface and said bottom surface, said plurality of holes are smaller in diameter than said one or more cup holders and in that said plurality of holes permit wind to blow through said table top, and one or more foldable legs attached to said bottom surface of said table top, said one or more foldable legs are designed to position said top surface of said table top at a height in the range of 10" to 20" above a ground surface on which said portable outdoor table sits.

BRIEF DESCRIPTION OF THE DRAWINGS

The detailed description will refer to the following drawings, wherein like numerals refer to like elements, and wherein.

DETAILED DESCRIPTION

Figure 1B:
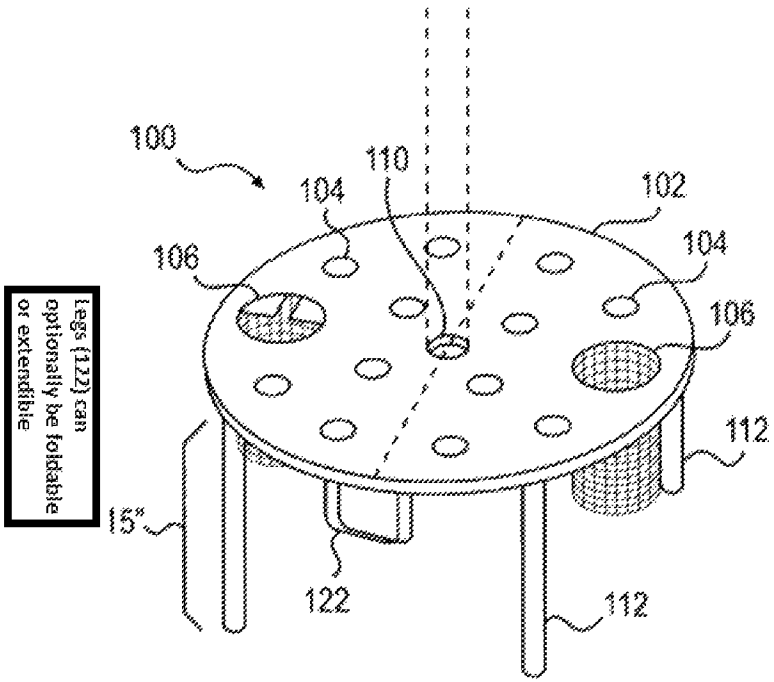
FIG. 1B is a perspective view of a circular embodiment of the portable folding outdoor table.

Described herein are embodiments of a portable folding outdoor table. Embodiments provide a portable folding outdoor table that is appropriately sized for the low-sitting portable folding beach chairs. Embodiments are stable enough to use on a surface such as the beach or in the windy conditions that often occur outdoors at the beach or pool. Embodiments provide a flat surface useful for food, card-playing, small portable electronics or speakers and other things. Embodiments provide drink holders that are designed to securely hold drinks even in windy conditions. Embodiments are adapted to work with beach umbrellas, including embodiments that are built with holes into which a beach umbrella may be inserted.

The portable folding outdoor table may be a variety of shapes, including square, rectangular, circular and oval. Typically, the table top of embodiments will fold in half or in thirds. The legs of embodiments will typically fold underneath the table top portions. Embodiments will include holes in the table top that allow wind to flow through the table top. Solid table tops are more susceptible to being blown or lifted by the wind. Consequently, the holes reduce the chances that the table will be blown over—which is a necessary concern because of lightweight material preferred for embodiments of the portable folding outdoor table. Such holes may be substantially-sized, relatively few in number and spaced out at regular intervals. Alternatively, the table top could include numerous small holes, presenting a screen or grill like surface.

Embodiments of the portable folding outdoor table may be a variety of different sizes. Generally, embodiments will be small enough to be carried when folded. For example, embodiments may include a three feet (3') diameter circular folding table, a four feet (4') by two feet (2') rectangular folding table, a two feet (2') by two feet (2') square folding table, a three and a half feet (3.5') by one and a half feet (1.5') oval table, and virtually any variety of similar shapes and sizes that make for an easily portable folding table. Embodiments may fold in halves, thirds, quarters or other configurations.

The portable folding outdoor table is typically made of durable but lightweight material. For example, embodiments may be made from recycled plastic, such as lightweight high-density polyethylene (HDPE) recycled plastic. Using recycled plastic is economical and environmentally friendly. Other recyclable materials may be used, including composite materials. Other lightweight, durable and easily washable materials may be used.

Embodiments of the portable folding outdoor table typically include folding legs that, when folded, fit snugly against the folded portions of the table top. Alternatively, the legs may be easily removable and re-attachable to the table top. The legs typically are sized to position the table top at a height that is comfortable for use with low-sitting beach chairs. For example, the legs may be sized to position the table top ten to twenty inches (10" to 20") off the ground. An embodiment of the portable folding outdoor table may include legs that positions the table top fifteen inches (15") off the ground when in use. The legs themselves may be longer than the desired height in order allow the feet of the legs to sink into the beach sand (or other soft surface) for proper anchoring. Certain embodiments may include threaded feet that rotate and screw into the ground for even more secure anchoring. The legs may include telescoping features that allow the legs to be lengthened depending on the surface on which the legs sit and/or the desired height of the table top. In this manner, the height of the table top of the portable folding outdoor table may be adjusted.

Embodiments may also include a central hole for holding a beach umbrella. In this manner, the portable folding outdoor table may be used in conjunction with a beach umbrella to provide a shaded table for use on the beach.

The portable folding outdoor table may also include cup holders for drinks. The cup holders may be holes meant to snugly hold cups or include bottoms, such as mesh fabric bottoms often used on beach chair arms. Exemplary cup holders may be, e.g., four to five inches (4"-5") in diameter and be two to four inches (2"-4") deep, with an embodiment including four and a quarter inch (4.25") diameter and three inches (3") deep cup holders. Some cup holders may include inserts that include a slot for holding stem glasses, such as wine glasses. Glass stems fit snugly within the slot. Embodiments of the portable folding outdoor table include at least four (4) cup holders.

Embodiments of the portable folding outdoor table may also include additional features, such as a water-proof or water-resistant pouches, bags or other enclosures meant to protect electronics. Other features may include Velcro straps that may be used to hold various items to the portable folding outdoor table, such as sandals, sunglasses, umbrellas or other items. Embodiments may be designed to be easily carried. For example, embodiments may include a handle and/or and adjustable strap that enable the folded portable folding outdoor table to be easily carried. Embodiments of the portable folding outdoor table include two (2) handles.

Figure 1A:
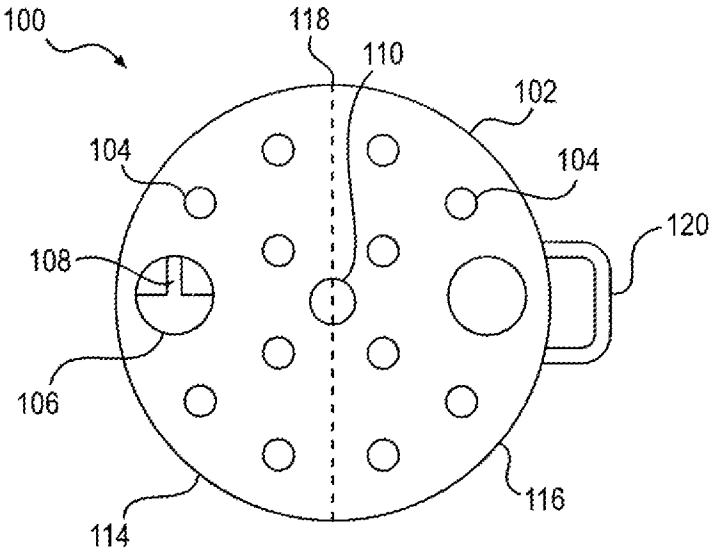
FIG. 1A is a top view of a circular embodiment of the portable folding outdoor table.

With reference now to FIGS. 1A and 1B, shown is an embodiment of the portable folding outdoor table 100. Portable folding outdoor table 100 has a circular table top 102. The circular table top 102 includes a substantially flat top surface and an opposite facing bottom surface. Portable folding outdoor table 100 includes holes 104 that enable wind to blow through the table, preventing or reducing changes portable folding outdoor table 100 will be blown over by the wind. Portable folding outdoor table 100 also includes one or more cup holders 106. Embodiments include four (4) cup holders 106. As shown in FIG. 1B, cup holders 106 may include mesh that holds cups. Other cup holders 106 may include slots 108 that hold glass stems. Portable folding outdoor table 100 also includes center umbrella hole 110 through which beach umbrella shaft is placed.

As shown in FIG. 1B, portable folding outdoor table 100 includes legs 112. Legs 112 may be sized to position the table top ten to twenty inches (10" to 20") off the ground, although legs 112 shown position the table top 102 approximately fifteen inches (15") off the ground. Most beach chairs sit low to the ground so that they are not easily blown over by strong sea winds. People also like the low-sitting beach chairs because they can feel more of the warm sun, perhaps digging their legs into the sand. In embodiments, the portable folding outdoor table 100 is designed to sit at a convenient low height for the low-sitting beach chairs. This also helps prevent the portable folding outdoor table 100 from blowing over. Legs 112 may fold into the underneath of the table top 102 to enable easier portability. The table top 102 may include multiple portions 114, 116 that separate, enabling the portable folding outdoor table 100 to, be folded. The table top 102 may include a joint 118 where the portions 114, 116 meet. The joint 118 may include one or more hinges 118, or other connections, that keep the portions 114, 116. Alternatively, the portions 114, 116 may be formed from one piece of material that is only partially cut to form joint 118. Other embodiments of portable folding outdoor table 100 may include three portions, e.g., pie-shaped portions, that enable portable folding outdoor table 100 to be folded in thirds.

With continuing reference to FIG. 1B, shown also is handle 120 and strap 122. Strap 122 is adjustable to enable a user to carry the folded portable folding outdoor table 100 by placing strap over a shoulder. Embodiments include two (2) handles 120. The handles 120 may be made with Velcro so that the handles 120 may connect to each other when the portable folding outdoor table 100 is folded. Portable folding outdoor table 100 may also include a latch or latches that hold the folded portions of the portable folding outdoor table 100 together. A strip of fabric with a snap or snaps connecting the fabric to the folded portions of the portable folding outdoor table 100 may also be used. Various other means for securing the folded portions of the portable folding outdoor table 100 together may be used.

Figure 2:
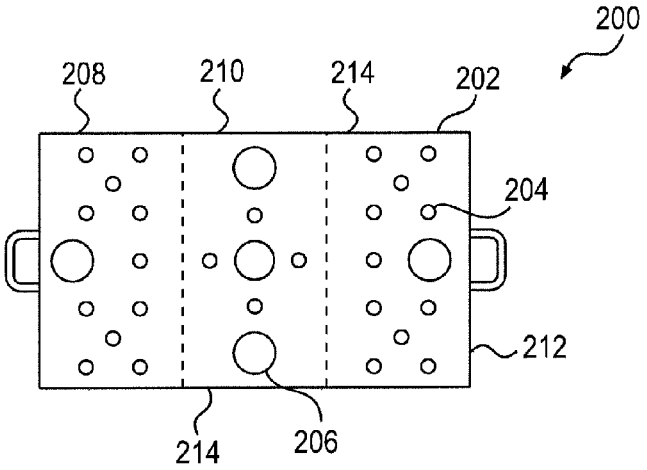
FIG. 2 is a top view of a rectangular embodiment of the portable folding outdoor table.

With reference now to FIG. 2, shown is a rectangular embodiment of the portable folding outdoor table 200. Rectangular portable folding outdoor table 200 includes a rectangular table top 202, holes 204 (to enable wind to blow through table top 202), one or more cup holders 206, and legs (not shown). Rectangular table top 202 includes three portions 208, 210, 212 joined together at joints 214 that enables portable folding outdoor table 200 to be folded.

Figure 3:
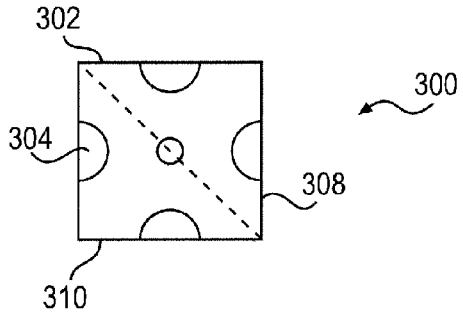
FIG. 3 is a top view of a square embodiment of the portable folding outdoor table.

With reference now to FIG. 3, shown is a square embodiment of the portable folding outdoor table 300. Square portable folding outdoor table 300 includes a square table top 302, holes 304 (to enable wind to blow through table top 302), one or more cup holders and legs (not shown). Square table top 302 includes two portions 308, 310 joined together at joint 312 that enables portable folding outdoor table 300 to be folded.

Figure 4:
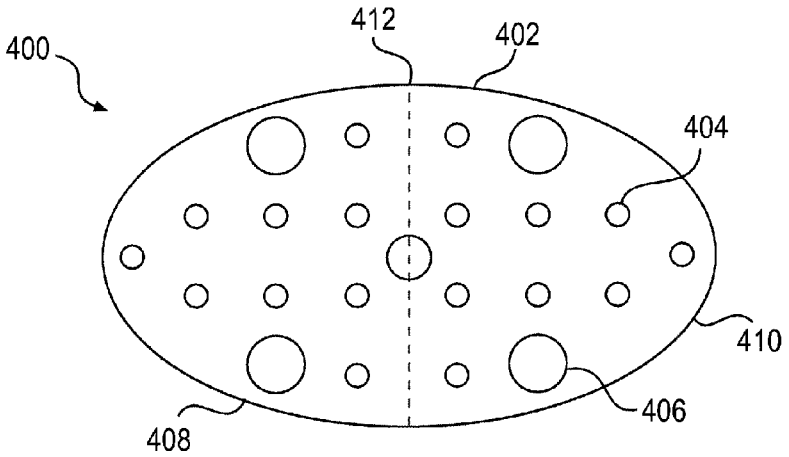
FIG. 4 is a top view of an elliptical embodiment of the portable folding outdoor table.

With reference now to FIG. 4, shown is oval embodiment of the portable folding outdoor table 400. Oval portable folding outdoor table 400 includes an oval table top 402, holes 404 (to enable wind to blow through table top 402), one or more cup holders 406, and legs (not shown). Oval table top 402 includes two portions 408, 410 joined together at joint 412 that enables portable folding outdoor table 400 to be folded.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

What is claimed is:

1. A portable folding outdoor table, comprising:

a foldable table top, wherein the table top includes:

a substantially flat top surface;

an opposite facing bottom surface, wherein said table top includes two or more foldable portions joined together at one or more joints that extend through said top surface and said bottom surface;

one or more cup holders extending through said top surface and said bottom surface, wherein each cup holder has a bottom surface that prevents cups or glasses placed in the cup holder from falling;

a beach umbrella shaft hole defined by said table top, substantially positioned at said table top center, and extending through said top surface and said bottom surface, wherein said beach umbrella shaft hole is sized to accept a shaft of a beach umbrella; and a plurality of holes defined by said table top and extending through said surface and said bottom surface, wherein said plurality of holes are smaller in diameter than said one or more cup holders, said plurality of holes permit wind to blow through said table top and items placed in any of the plurality of holes that is smaller than the diameter of the hole will fall through the hole; and one or more legs attached to said bottom surface of said table top, wherein said one or more legs are designed to position said top surface of said table top at a height in the range of 10" to 20" above a ground surface on which said portable outdoor table sits.

2. The portable folding outdoor table of claim 1 wherein said one or more legs are designed to position said top surface of said table top at approximately 15" above said ground surface.

3. The portable folding outdoor table of claim 1 wherein said one or more legs are adjustable in length.

4. The portable folding outdoor table of claim 1 wherein said one or more legs are foldable legs and said one or more foldable legs fold towards said bottom surface.

5. The portable folding outdoor table of claim 1 wherein said table top includes two foldable portions joined together at one joint that permits said portions to fold together so that said top surfaces of each portion faces each other when folded.

6. The portable folding outdoor table of claim 1 further comprising one or more straps connected to said bottom surface of said table top to enable said one or more straps to be used to carry said table when folded.

7. The portable folding outdoor table of claim 1 further comprising one or more handles connected to said table top to enable said one or more handles to be used to carry said table when folded.

8. The portable folding outdoor table of claim 1 wherein said table top is circular.

9. The portable folding outdoor table of claim 1 wherein said table top is square.

10. The portable folding outdoor table of claim 1 wherein said table top is rectangular.

11. The portable folding outdoor table of claim 1 wherein said table top is oval.

12. The portable folding outdoor table of claim 1 wherein said table top includes three foldable portions.

13. The portable folding outdoor table of claim 1 wherein said one or more cup holders include a mesh bottom.

14. The portable folding outdoor table of claim 1 wherein said one or more cup holders include a stem holder for holding glass stems.

15. The portable folding outdoor table of claim 1 wherein said table top is made from recycled material.

16. The portable folding outdoor table of claim 1 wherein said table top is made from lightweight high-density polyethylene (HDPE) recycled plastic.

* * * * *